US006168091B1

(12) United States Patent
Rodier et al.

(10) Patent No.: US 6,168,091 B1
(45) Date of Patent: Jan. 2, 2001

(54) LOW NOISE ELECTRONICALLY ACTUATED OIL VALVE AND FUEL INJECTOR USING SAME

(75) Inventors: William J. Rodier, Metamora; Haji Goudarz, Normal, both of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/373,513

(22) Filed: Aug. 12, 1999

(51) Int. Cl.[7] ..... F02M 47/02

(52) U.S. Cl. ..... 239/88; 239/124; 239/533.2; 239/585.1; 123/446; 123/467; 251/48; 251/51

(58) Field of Search ..... 239/88, 92, 533.2, 239/533.9, 585.1, 585.4, 585.5, 124; 123/446, 458, 467; 251/48, 51–54, 129.01, 129.15, 129.16

(56) References Cited

U.S. PATENT DOCUMENTS 5,125,807 * 6/1992 Kohler et al. ..... 123/458 X
5,236,173 8/1993 Wakeman .
5,375,576 12/1994 Ausman et al. .
5,651,501 * 7/1997 Maley et al. ..... 239/88
5,752,659 * 5/1998 Moncelle ..... 239/88
5,806,766 * 9/1998 Krueger et al. ..... 239/533.2 X
5,820,033 * 10/1998 Cooke ..... 239/585.5
5,904,300 * 5/1999 Augustin ..... 239/533.2

* cited by examiner

*Primary Examiner*—Andres Kashnikow
*Assistant Examiner*—Steven J. Ganey
(74) *Attorney, Agent, or Firm*—Michael B. McNeil

(57) ABSTRACT

A hydraulically actuated fuel injector includes an injector body that defines a high pressure passage, a low pressure passage, a control passage, a fuel inlet, and a nozzle outlet. The injector body includes upper surface and a lower surface that partially define an armature cavity. The injector body also defines a fluid displacement passage that is separated from the upper surface and the lower surface and extends between the armature cavity and a low pressure area. The fluid displacement passage is positioned and sized such that an amount of oil is always maintained in the armature cavity at least to a level below the fluid displacement passage but above the lower surface. In addition, the fluid displacement passage is sized and positioned to ensure adequate drainage for cold start, yet provide a flow restriction especially at idle conditions to produce sufficient valve damping that a substantial reduction in impact noise occurs.

20 Claims, 4 Drawing Sheets

LOW NOISE ELECTRONICALLY ACTUATED OIL VALVE AND FUEL INJECTOR USING SAME

TECHNICAL FIELD

The present invention relates generally to electronically actuated oil valves, and more particularly to a noise reducing oil control valve for a hydraulically actuated fuel injector.

BACKGROUND ART

Caterpillar, Inc. of Peoria, Ill. manufactures a line of hydraulically-actuated electronically-controlled fuel injectors that have been well received and performed magnificently for many years. These fuel injection systems use high pressure lubricating oil from a common rail as a working fluid to pressurize distillate diesel fuel within each individual fuel injector for injection. Each individual injector includes an electronically actuated control valve that opens and closes the fuel injector to the common rail source of high pressure oil. Typically, this control valve includes a solenoid armature attached to a poppet valve that is moveable between a high pressure seat and a low pressure seat. To initiate each injection event, the solenoid is energized to pull the armature and poppet valve member upward from the high pressure seat toward the low pressure seat. This allows high pressure oil to flow into the fuel injector to move an intensifier piston and pressurize fuel for an injection event.

Although the control valve generally only has to move on the order of hundreds of microns between its closed and opened positions, it must move relatively fast in order to maintain performance at acceptable levels. This relatively high speed movement between positions results in the poppet valve member impacting its seats with a certain impact velocity. These impacts produce noise, which can be annoying when not drowned out by other engine noise, such as at idle conditions. In some instances, those unfamiliar with the proper operating sounds of the system can misperceive this clicking noise produced by the poppet valve hitting its seat as an indicator of some malfunction in the engine. In general, the clicking noise is barely, if at all perceptible at higher engine operating conditions because of the other engine noises, such as combustion, tend to drown out the poppet impact noise.

Because of the annoyance sometimes caused by the injector noise, particularly at idle, engineers are often seeking ways to make the system quieter. Unfortunately, it is often difficult to reduce noise at idle conditions while not undermining performance at rated conditions, or undermining the engines cold start ability. Those skilled in the art will appreciate that noise at idle can be reduced by lowering the impact velocity, and this can be accomplished by exploiting the available oil to slow the movement of the armature and poppet valve member. Unfortunately, solutions to this perceived noise problem that do not undermine the engine's cold start abilities or undermine injector performance at higher operating conditions is often elusive.

An earlier Caterpillar, Inc. U. S. patent to Ausman, et al., identifies and discusses some issues relating to damping the motion of oil control valves in hydraulically actuated fuel injectors. Ausman, et al., recognized that an amount of oil often must be displaced when the valve moves from one position to another. Although Ausman, et al., did not discuss the issue of noise at idle or at any other operating conditions, they did recognize that the valves motion could be damped by restricting the displacement of oil that occurs when the valve moves from one position to another. Ausman, et al., appears to be directed toward providing a sufficient amount of damping to prevent excessive bouncing when the valve member impacts its seat, rather than toward strategies for reducing noise produced by such an impact. In order to maintain the ability to cold start an engine, Ausman, et al., teaches a structure that ensures that virtually all damping oil in the armature cavity has the ability to drain away when the engine is shut down. In fact, Ausman, et al., specifically teaches a structure that prevents highly viscous oil from entering the armature cavity, where damping takes place, during cold start up conditions. While Ausman, et al., does touch upon some of the issues relevant to present invention, they fail to recognize any problem associated with injector noise at idle conditions, or provide any teaching that could be applied toward reducing injector noise across its operating range while preserving the engine's ability to cold start.

The present invention is directed to these and other problems associated with injector noise and cold starting ability.

DISCLOSURE OF THE INVENTION

An electronic controlled oil valve includes a valve body having an upper surface and a lower surface that partially define an armature cavity. The valve body also defines a fluid displacement passage that is separated from the upper surface and lower surface, and extends between the armature cavity and a low pressure area. A solenoid that includes an armature is positioned in the armature cavity. A valve member is attached to the armature and moveable in the valve body between a first position and a second position. The armature cavity decreases in volume when the valve member moves toward its first position. An amount of oil is maintained in the armature cavity at a level below the fluid displacement passage, but above the lower surface. The electronically controlled oil valve finds preferred application as a control valve in a hydraulically actuated fuel injector.

BEST MODE FOR CARRYING OUT THE INVENTION

Figure 1:
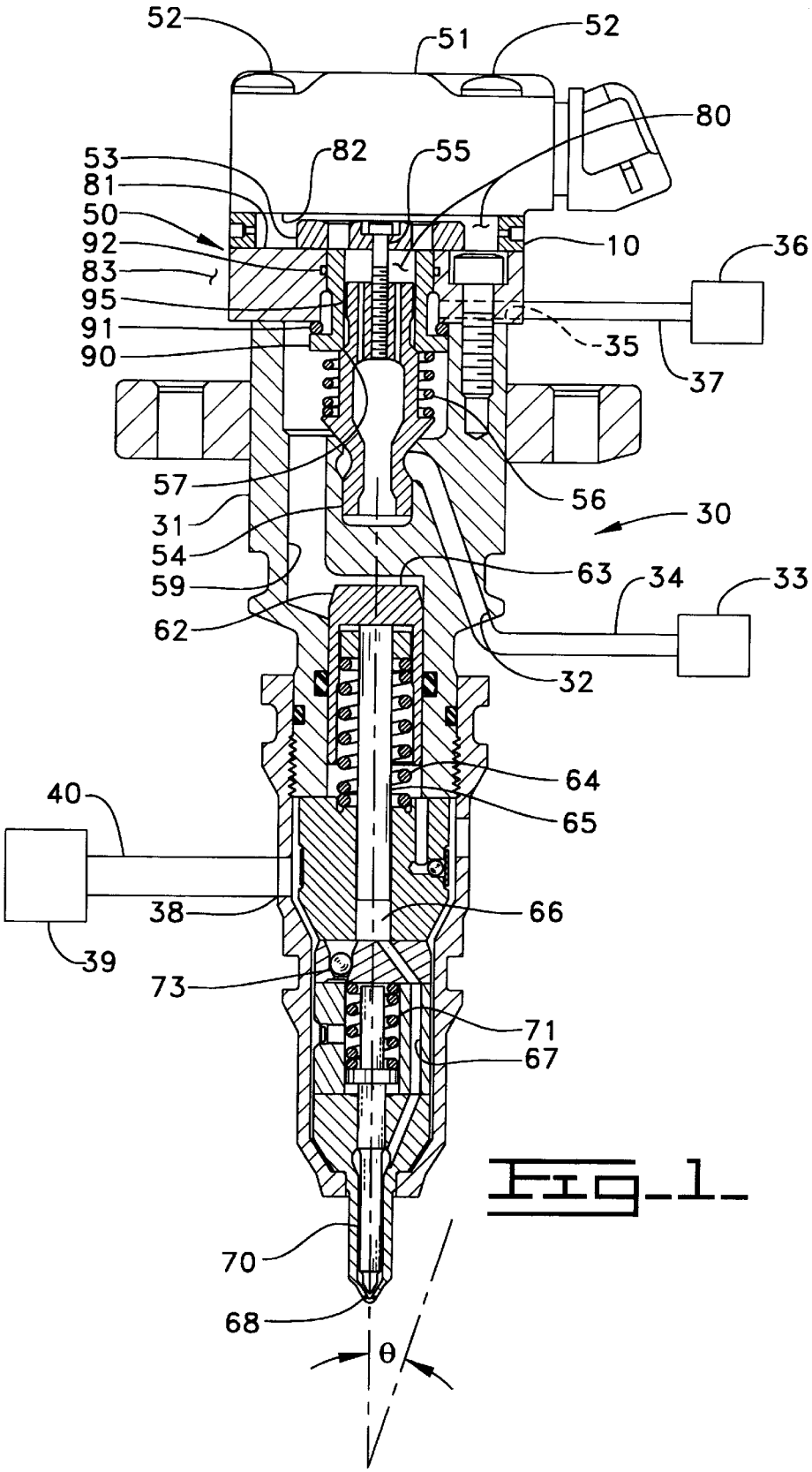
FIG. 1 is a sectioned side diagrammatic view of a hydraulically actuated electronically-controlled fuel injector according to the present invention.
Figure 2:
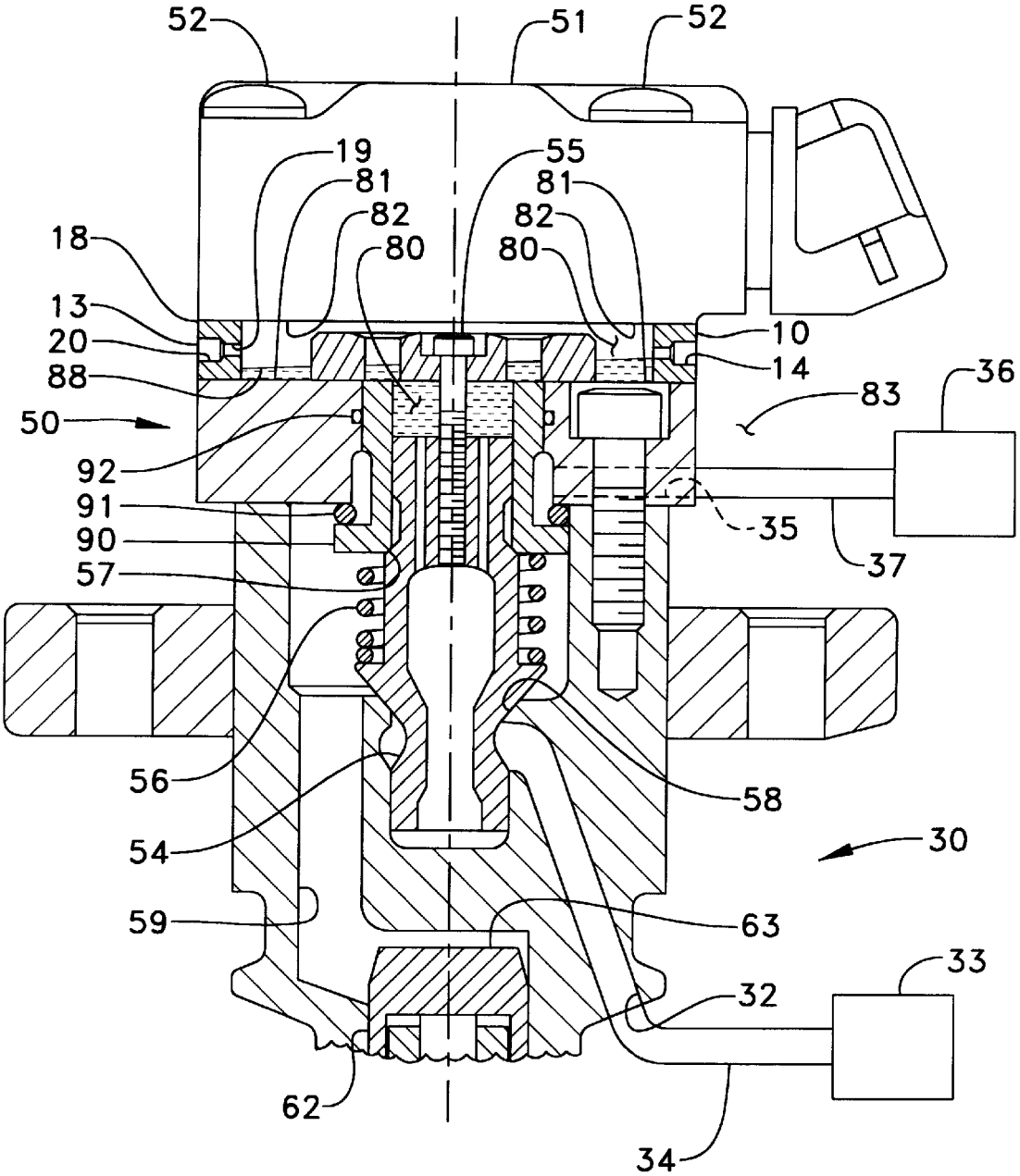
FIG. 2 is an enlarged sectioned side diagrammatic view of the hydraulically actuated device portion of the fuel injector shown in FIG. 1.
Figure 3:
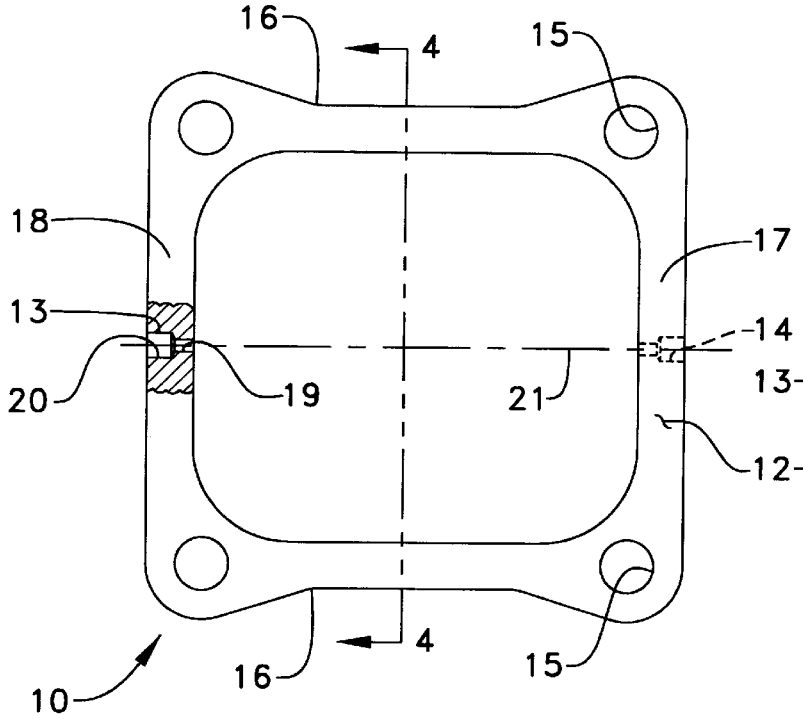
FIG. 3 is a top view of a solenoid spacer that defines a portion of an armature cavity according to one aspect of the present invention.
Figure 4:
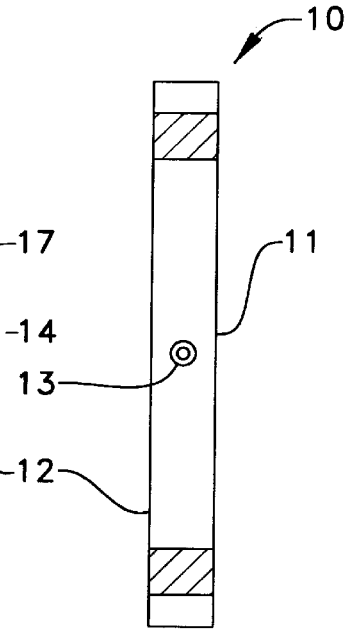
FIG. 4 is a side sectioned view of the solenoid spacer of FIG. 3 as viewed along section lines A—A.

Referring now to FIGS. 1–4 there are shown various views of a hydraulically actuated electronically-controlled fuel injector 30 according to the present invention. Fuel injector 30 includes an injector body 31 made up of various components that are attached to one another in a manner well known in the art and positioned as they would be just prior to an injection event. Actuation fluid can flow into a high pressure actuation fluid passage 32 defined by injector body 31 through high pressure oil supply line 34 from the source of high pressure oil 33. At the end of an injection event, oil can flow out of a low pressure passage 35 defined by injector body 31 through an oil drain passage 37 into low pressure fluid reservoir 36. While a number of different fluids could be used as actuation fluid, the present invention preferably utilizes engine lubricating oil. Fuel, such as distillate diesel fuel, can flow into injector body 31 from a fuel source 39 through fuel supply line 40, into fuel inlet 38.

Fuel injector 30 is controlled in operation by an oil valve 50 that includes a solenoid 51 which is attached to injector body 31 by a plurality of fasteners 52. Solenoid 51 includes an armature 53 which is positioned within an armature cavity 80. An upper surface 82, a lower surface 81 of injector body 31, partially define armature cavity 80. Additionally, a spacer 10, which defines an indentation 16, acts to partially define armature cavity 80. Spacer 10 also defines a number of fastener bores 15 through which bolts pass during assembly of fuel injector 30. A poppet valve member 54 is attached to armature 53 by a fastener 55 and moves within a poppet sleeve 90. A poppet shim 91 is positioned above poppet sleeve 90 and acts as a spacer which properly positions poppet sleeve 90. An oaring seal 92 is positioned in an annular clearance area 95 located between poppet sleeve 90 and oil valve 50. O-ring seal 92 acts to substantially block fluid communication between armature cavity 80 and a control passage 59 defined by injector body 31. Poppet valve member 54 is moveable within poppet sleeve 90 between a high pressure seat 58 and a low pressure seat 57.

Poppet valve member 54 is biased toward high pressure seat 58 by a biasing spring 56. When poppet valve member 54 is seated at high pressure seat 58, low pressure actuation fluid contained in a control passage 59 can exit fuel injector 30 through low pressure passage 35 into low pressure reservoir 36. When solenoid 51 is activated, armature 53 pulls poppet valve member 54 toward low pressure seat 57 against the action of biasing spring 56. When poppet valve member 54 is seated in low pressure seat 57, high pressure actuation fluid can flow into control passage 59 via high pressure actuation fluid passage 32. As poppet valve member 54 is pulled toward low pressure seat 57, armature cavity 80, which contains an amount of oil at or above a residual oil level 88, decreases in volume.

Armature cavity 80 is fluidly connected to a low pressure area 83, which is outside injector body 31, by a pair of fluid displacement passages 13, 14. Residual oil level 88 is below fluid displacement passages 13, 14 but above lower surface 81 of injector body 31. Fluid displacement passages 13, 14 are both defined by spacer 10 and are substantially similar in size but are located opposite one another along a common centerline 21. Preferably, fluid displacement passages 13, 14 are located about halfway between upper surface 82 and lower surface 81 and about halfway between a top surface 12 and a bottom surface 11 of spacer 10. This placement is preferable because if fluid displacement passages 13, 14 are placed too close to bottom surface 11, too much oil can drain from armature cavity 80 to provide sufficient noise damping at low engine operating conditions, when the duration between injection events is long. Likewise, if fluid displacement passages 13, 14 are placed too close to top surface 12, a substantial amount of oil can be trapped in armature cavity 80 which can inhibit the cold start performance of fuel injector 30 because of any trapped high viscosity oil at cold start.

Fluid displacement passages 13, 14 should extend through a pair of sidewalls 17, 18 of spacer 10, which is a portion of injector body 31. A small flow area 19, which is preferably cylindrical in shape, and a large flow area 20 are included in fluid displacement passages 13, 14. Fluid displacement passages 13, 14, and therefore small flow area 19 and large flow area 20, should be sized to be sufficiently restrictive to fluid flow such that poppet valve member 54 is slowed when approaching low pressure seat 57 when the viscosity of oil contained within armature cavity 80 is low, for instance at rated engine operating conditions. However, fluid displacement passages 13, 14, small flow area 19 and large flow area 20 should also be sized to be substantially unrestrictive to fluid flow such that oil can be drained from armature cavity 80 when the engine is turned off, and the viscosity of the oil is increasing from cooling. For these reasons, fluid displacement passages 13, 14 should have a controlled length and a combined flow area of less than about 2 square millimeters in this fuel injector application.

It should be appreciated that the size and positioning of fluid displacement passages 13, 14 have been determined due to the orientation of fuel injector 30 in an engine. As shown in FIG. 1, fuel injector 30 is actually attached to the engine at an angle θ, which is on the order of 11° in this example application. If, however, fuel injector 30 is to be used at a different angle, the size, positioning, and orientation, in addition to the number, of fluid displacement passages 13, 14 would have to be reevaluated. There are four primary factors that should be used in determining any alteration in these factors due to alternate orientation of fuel injector 30 in an engine. These include, the actual orientation of fuel injector 30 in the engine, the ability of the fluid displacement passages to evacuate a sufficient amount of oil at shutdown to enable cold start of the engine, the ability of the fluid displacement passages to maintain a sufficient amount of oil in armature cavity 80 at idle conditions to perform the desired damping and noise reduction, and allow sufficient fluid flow out of the fluid displacement passages to not significantly inhibit injector 30 performance at rated conditions. It should be appreciated that these primary factors were evaluated to determine the placement of fluid displacement passages 13, 14 for the angle θ that has been shown in FIGS. 1–4.

Figure 5:
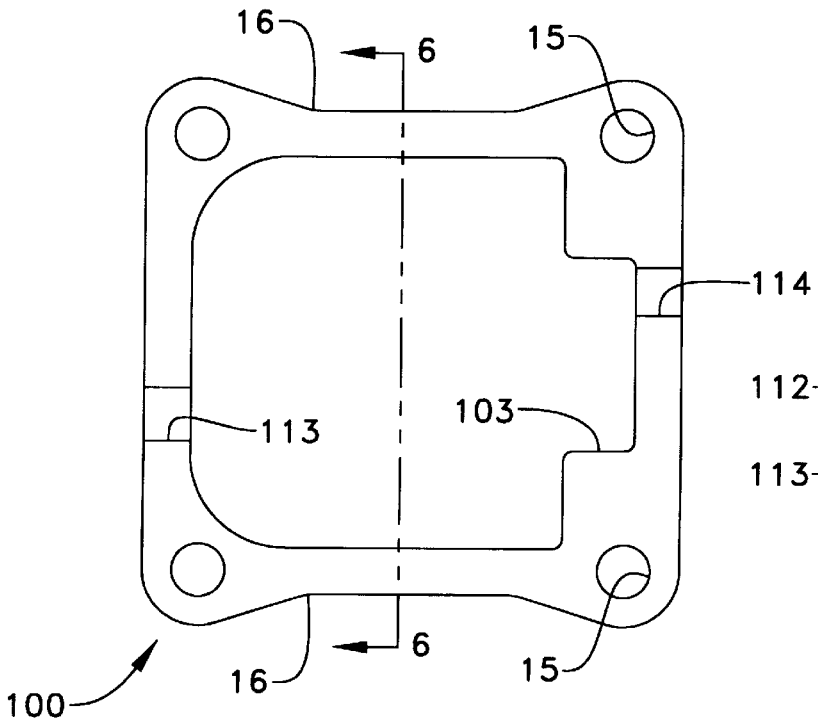
Fig 5 (PRIOR ART)
FIG. 5 is a top view of a solenoid spacer according to the Ausman, et al., Pat. No. (5,375,576).
Figure 6:
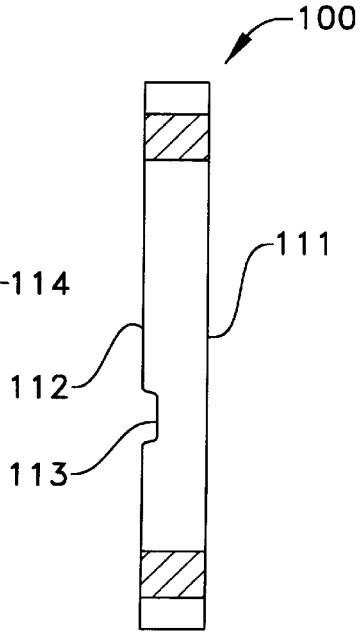
Fig 6 (PRIOR ART)
FIG. 6 is a sectioned side view of the Ausman, et al., solenoid spacer as viewed along sectioned lines B—B.

Referring now to FIGS. 5–6, there is shown a solenoid spacer 100 according to the Ausman, et al. patent. The Ausman spacer 100 also defines a top surface 111 and a bottom surface 112 as well as an orientation guide 103 which is included to ensure correct placement of spacer 100 in a fuel injector. Spacer 100 defines two drain passages 113, 114 which are defined by opposing side walls of spacer 100. Unlike the present invention, drain passages 113, 114 are preferably at or near bottom surface 112 in the Ausman patent to ensure evacuation of all oil trapped in the armature cavity at shut down before the next cold start. The Ausman drain passages 113, 114 are also unlike the present invention in that they are rectangular in shape. The present invention utilizes a cylindrical shape for drain passages 13, 14 rather than the rectangular shape of drain passages 113, 114 to allow for a tighter tolerance and to improve consistency of noise reduction between individual fuel injectors. For example, the cylindrical drain passages 13, 14 of the present invention, can be machined to tighter tolerances than rectangular drain passages 113, 114 because the manner of machining drain passages 13, 14 which are drilled rather than stamped like the Ausman drain passages. Further, due to both the manner of machining and the cylindrical shape of drain passages 13, 14, there is a greater consistency between fuel injectors which will lead to a greater overall reduction of noise in an engine.

Referring back to FIGS. 1 and 2, injector body 31 also includes a piston 62 which can move between an upward position, as shown, and a downward advanced position. Piston 62 is biased toward its upward position by a return spring 64. Connected to piston 62 is a plunger 65. As with piston 62, plunger 65 is biased toward its upward position by return spring 64. Piston 62 advances due to the hydraulic pressure force exerted on a hydraulic surface 63 which is exposed to fluid pressure in control passage 59. When piston 62 begins to advance, plunger 65 advances in a corresponding fashion and acts as the hydraulic means for pressurizing fuel within injector 30. Injector body 31 and plunger 65 define a fuel pressurization chamber 66 that is connected to fuel inlet 38 past a check valve 73. When plunger 65 is returning to its upward position, fuel is drawn into fuel pressurization chamber 66 past check valve 73. During an injection event as plunger 65 moves toward its downward position, check valve 73 is closed and plunger 65 can act to compress fuel within fuel pressurization chamber 66. Fuel pressurization chamber 66 is fluidly connected to a nozzle outlet 68 via a nozzle supply passage 67.

A needle valve member 70 is movably mounted in injector body 31 between a first position, in which nozzle outlet 68 is open, and a downward second position in which nozzle outlet 68 is blocked. Needle valve member 70 is mechanically biased toward its downward closed position by a biasing spring 71. The strength of needle biasing spring 71 defines a valve opening pressure. When the pressure exerted on an opening hydraulic surface of needle valve member 70 exceeds the valve opening pressure, the pressure is then sufficient to move needle valve member 70 against the action of needle biasing spring 71 to open nozzle outlet 68. The fuel within fuel pressurization chamber 66 is then permitted to flow through nozzle supply passage 67 and out nozzle outlet 68 into the combustion space. At the end of the injection event, when the fuel pressure within fuel pressurization chamber 66 drops below a valve closing pressure, needle valve member 70 returns to its biased position, closing nozzle outlet 68 and ending fuel flow into the combustion space.

INDUSTRIAL APPLICABILITY

Prior to the start of an injection event, low pressure in fuel pressurization chamber 66 prevails and control passage 59 is open to low pressure passage 35, piston 62 and plunger 65 are in their respective upward positions, and needle valve member 70 is in its seated position closing nozzle outlet 68. The injection event is initiated by activation of solenoid 51. When solenoid 51 is activated, armature 53 pulls poppet valve member 54 away from high pressure seat 58 and against the action of biasing spring 56. The movement of poppet valve member 54 to low pressure seat 57 closes control passage 59 to low pressure passage 35 and opens it to high pressure actuation fluid passage 32. Actuation fluid can now flow into control passage 59 from the source of high pressure oil 33, via high pressure oil supply line 34. Recall that while a number of fluids could be used as actuation fluid, the present invention uses engine lubricating oil.

The impacting of poppet valve member 54 to low pressure seat 57 creates a clicking noise that is not drowned out by other engine noise at idle operating conditions. While this noise does not represent a performance problem associated with fuel injector 30, it is sometimes perceived as such. The present invention exploits the actuation fluid which migrates into armature cavity 80 to damp this noise at idle operating conditions. When poppet valve member 54 moves toward low pressure seat 57, a certain amount of oil can flow upward into armature cavity 80 through the annular clearance area 95 between poppet valve member 54 and poppet sleeve 90. Fluid displacement passages 13, 14 are vertically placed in spacer 10 along centerline 21 to allow an adequate amount of oil to remain in armature cavity 80 to dampen the clicking noise, even during the extended duration between injection events indicative of idle operating conditions. Fluid displacement passages 13, 14 are also sized to be sufficiently restrictive to allow adequate damping when oil viscosity is low while being sized to be sufficiently unrestrictive to allow adequate oil drainage from armature cavity 80 when oil viscosity is high. In this manner, the present invention provides adequate drainage during rated conditions to prevent undermining performance as well as providing adequate drainage after engine shut-off to not inhibit cold start.

Returning to the injection event, pressure within control passage 59 begins to rise due to the high pressure oil flowing into control passage 59 from high pressure actuation fluid passage 32 which causes a rise in the pressure acting on piston 62. The rise in pressure within control passage 59 begins to move piston 62 toward its downward position against the bias of return spring 64. The downward movement of piston 62 moves plunger 65 against the bias of return spring 64, closing check valve 73 and raising the pressure of the fuel within fuel pressurization chamber 66 and nozzle supply passage 67. The increasing pressure of the fuel within nozzle supply passage 67 acts on needle valve member 70. When the pressure exerted on needle valve member 70 exceeds a valve opening pressure, it is lifted against the action of needle biasing spring 71, and fuel is allowed to spray into the combustion chamber from nozzle outlet 68.

Shortly before the desired amount of fuel has been injected, solenoid 51 is deactivated to end the injection event. Poppet valve member 54 returns to high pressure seat 58 under the action of biasing spring 56. Control passage 59 is closed from fluid communication with high pressure oil source 33 which results in a drop in pressure within control passage 59, resulting in a corresponding drop in pressure acting on piston 62. The drop in pressure causes piston 62 and plunger 65 to stop their downward stroke. Because plunger 65 is no longer moving downward, the pressure of the fuel within fuel pressurization chamber 66 begins to drop. When the pressure of this fuel falls below the valve closing pressure, needle valve member 70 is pushed by needle biasing spring 71 toward its downward position to close nozzle outlet 68 and end the injection event.

Between injection events various components of injector body 31 begin to reset themselves in preparation for the next injection event. Because the pressure acting on piston 62 has dropped, return spring 64 moves piston 62 and plunger 65 back to their respective, upward positions. The retracting movement of intensifier piston 62 forces the actuation fluid from control passage 59 through low pressure passage 35 and oil drain passage 37 into low pressure reservoir 36 for recirculation. The retracting movement of plunger 65 causes fuel from fuel inlet 38 to be pulled into fuel pressurization chamber 66 through fuel supply line 40 past check valve 73.

Figure 7:
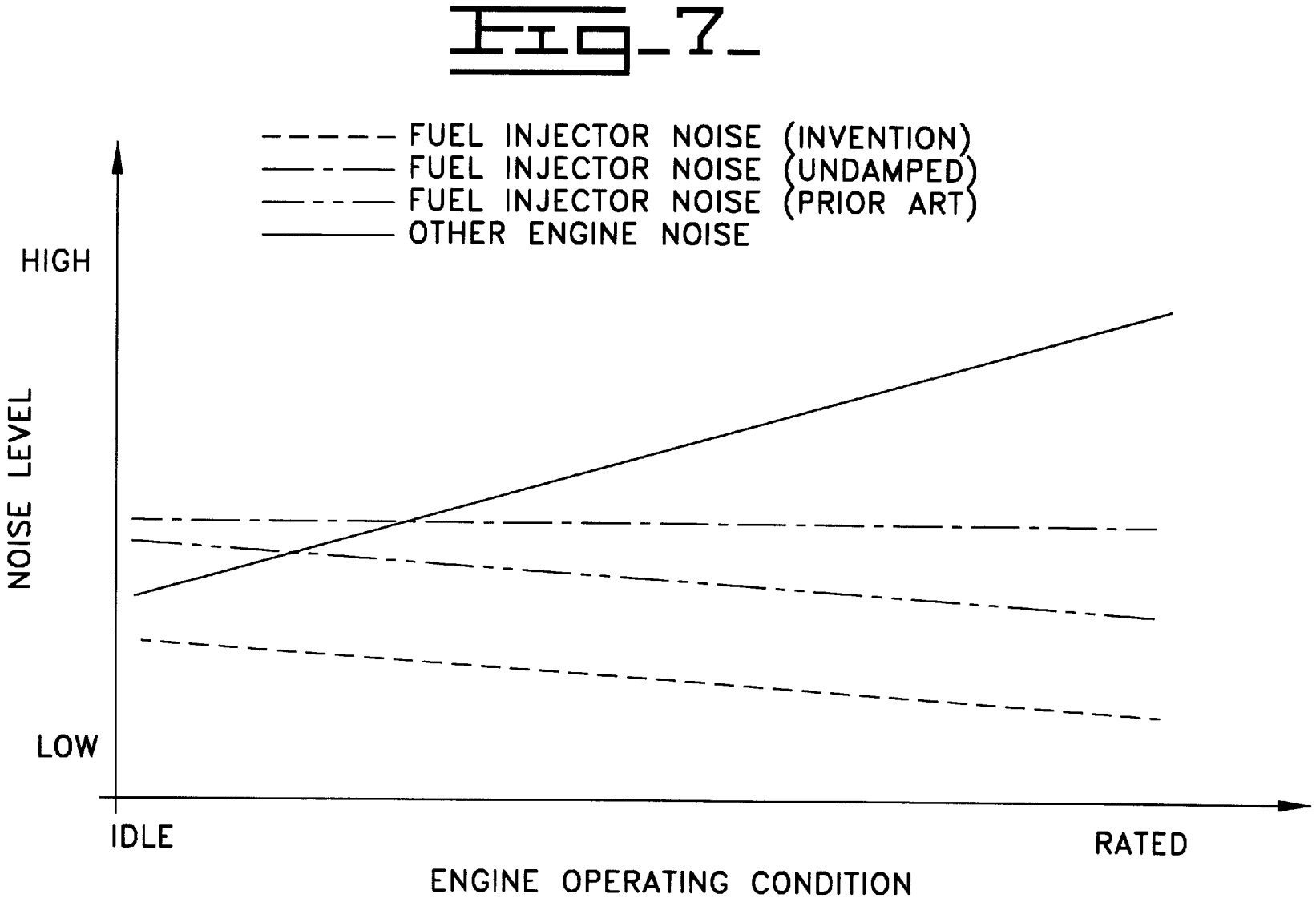
FIG. 7 is a graph of noise level as a function of engine operating condition for the present invention, an undamped fuel injector, and the Ausman fuel injector.

The present invention is better able to dampen the clicking noise created by seating of poppet valve member 54 during idle operating conditions than previous fuel injectors, such as the Ausman fuel injector, in a number of ways (FIG. 7). First, the present invention utilizes cylindrical fluid displacement passages as opposed to the rectangular drain passages in the Ausman fuel injector. Cylindrical passages can be machined to a very tight tolerance, unlike the rectangular passages, which will not only improve damping in individual fuel injectors, but will also lead to a greater consistency of damping between fuel injectors. Further, the fluid displacement passages of the present invention are located vertically above the bottom surface of the armature cavity in such a location that enough oil can remain in armature cavity 80 during idle operating conditions to effectively dampen the noise created by poppet valve member 54 while still preventing an inhibiting too much oil from being trapped in armature cavity 80 during rated conditions. In addition, the size and location of drain passages 13, 14 permit adequate drainage to retain the cold start ability. Further, because of the symmetry of along centerline 21, the spacer used in the present invention can be installed in a fuel injector either right side up or upside down with no effect on the noise reduction or cold start function of drain passages 13, 14. This is in contrast to the spacer used in the Ausman patent which should be inserted with drain passages 113, 114 at the bottom to ensure proper performance at cold start.

A series of tests were performed to determine the shape and location of drain passages 13, 14. In a first set of tests, an accelerometer was attached to the oil valve and the size of drain passages 13, 14 was reduced until a less powerful impact and a larger duration between impacts of poppet valve member 54 and low pressure seat 57 were measured. Another set of tests was performed where the size of drain passages 13, 14 was reduced until a 50% reduction of noise was measured. During these first two sets of tests, drain passages 13, 14 were composed of a uniform small flow area throughout their entire length. A third test was performed to determine if the fuel injector would perform sufficiently at cold start with this new reduced size of drain passages 13, 14. This test was initially unsuccessful, however, further testing revealed addition of the large flow area portion of drain passages 13, 14 would allow the fuel injector to perform satisfactorily at cold start conditions by shortening the effective flow restriction while still providing the desired amount of damping and noise reduction.

In the present invention, because damping is most sensitive to the small flow area portion of drain passages 13, 14, the large flow area segment could be added to improve drainage for cold start considerations without undermining the desired noise reduction. However, it should be repeated that the results of these tests are illustrative of the fact that drain passages 13, 14 are sensitive not only to their flow area and length, but also to the orientation angle θ. Therefore, when including the present invention in a device to be used at an angle other than the illustrated 11° angle, tests similar to those described above will have to be performed to determine the correct flow area, length and positioning of drain passages 13, 14.

It should be understood that the above description is intended only to illustrate the concepts of the present invention, and is not intended to in any way limit the potential scope of the present invention. For instance, it should be appreciated that the number and positioning of the fluid displacement passages an change as a result of an alternate vertical or horizontal placement of the fuel injector in the engine. Thus, various modifications could be made without departing from the intended spirit and scope of the invention as defined by the claims below.

What is claimed is:

1. An electronically controlled oil valve comprising:

a valve body that includes an upper surface and a lower surface that partially define an armature cavity, and further defining a fluid displacement passage that is located between said upper surface and said lower surface and extends between said armature cavity and a low pressure area;

said fluid displacement passage being sufficiently restrictive to fluid flow that said valve member is slowed when approaching said first position, but being sufficiently unrestrictive to fluid flow that oil above said fluid displacement passage can drain from said armature cavity when said valve member is at said second position;

said fluid displacement passage being at a location that traps a predetermined amount of oil in said armature cavity;

a solenoid including an armature positioned in said armature cavity;

a valve member attached to said armature and moveable in said valve body between a first position and a second position; and said armature cavity decreasing in volume when said valve member moves toward said first position.

2. The oil valve of claim 1 wherein said fluid displacement passage is located about halfway between said upper surface and said lower surface.

3. The oil valve of claim 1 wherein a portion of said fluid displacement passage has a minimum flow area that has a cylindrical shape.

4. The oil valve of claim 1 wherein said valve body has a side wall; and said fluid displacement passage extends through said side wall, and includes a large flow area segment and a small flow area segment.

5. The oil valve of claim 1 wherein said fluid displacement passage is located about halfway between said upper surface and said lower surface;

said valve body has a side wall;

said fluid displacement passage extends through said side wall, and includes a large flow area segment and a small flow area segment; and said small flow area segment has a cylindrical shape.

6. The oil valve of claim 1 wherein said fluid displacement passage is a first fluid displacement passage; and said valve body defines a second fluid displacement passage substantially identical to, but located opposite of said first fluid displacement passage.

7. The oil valve of claim 1 wherein said valve body includes a spacer in contact with said upper surface and said lower surface; and said spacer defines said fluid displacement passage.

8. The oil valve of claim 7 wherein said spacer has a shape that is symmetrical about a centerline of said fluid displacement passage.

9. A hydraulically actuated fuel injector comprising:

an injector body that defines a high pressure passage, a low pressure passage, a control passage, a fuel inlet and a nozzle outlet, and includes an upper surface and a lower surface that partially define an armature cavity, and further defining a fluid displacement passage that is located between said upper surface and said lower surface and extends between said armature cavity and a low pressure area;

said fluid displacement passage being sufficiently restrictive to fluid flow that said valve member is slowed when approaching said first position, but being sufficiently unrestrictive to fluid flow that oil above said fluid displacement passage can drain from said armature cavity when said valve member is at said second position;

said fluid displacement passage being at a location that traps a predetermined amount of oil in said armature cavity;

said high pressure passage being fluidly connected to a source of high pressure oil, and said low pressure passage being fluidly connected to a low pressure oil reservoir;

a solenoid including an armature positioned in said armature cavity;

a valve member attached to said armature and moveable in said injector body between a first position in which said high pressure passage is open to said control passage, and a second position in which said low pressure passage is open to said control passage;

said armature cavity decreasing in volume when said valve member moves toward said first position; and a moveable piston positioned in said injector body and having a hydraulic surface exposed to fluid pressure in said control passage.

10. The fuel injector of claim 9 wherein a portion of said fluid displacement passage has a minimum flow area that has a cylindrical shape.

11. The fuel injector of claim 10 wherein said injector body has a side wall; and said fluid displacement passage extends through said side wall, and includes a large flow area segment and a small flow area segment.

12. The fuel injector of claim 11 wherein said fluid displacement passage is located about halfway between said upper surface and said lower surface.

13. The fuel injector of claim 12 wherein said fluid displacement passage is a first fluid displacement passage; and said injector body defines a second fluid displacement passage substantially identical to, but located opposite of said first fluid displacement passage.

14. The fuel injector of claim 13 wherein said first fluid displacement passage and said second fluid displacement passage have a combined flow area of less than about 2 sq. mm.

15. The fuel injector of claim 9 wherein said injector body includes a spacer in contact with said upper surface and said lower surface; and said spacer defines said fluid displacement passage.

16. The fuel injector of claim 15 wherein said spacer has a shape that is symmetrical about a centerline of said fluid displacement passage.

17. A component for an electronically controlled oil valve comprising:

a spacer defining a plurality of openings extending from a top surface to a bottom surface, and further defining at least one fluid displacement passage extending between an inner surface and a non-circular outer surface;

said fluid displacement passage having a minimum flow area location with a cylindrical shape.

18. The component of claim 17 wherein said at least one fluid displacement passage has a combined flow area that is less than about 2 sq. mm.

19. The component of claim 18 wherein said spacer has a shape that is symmetrical about a centerline of said fluid displacement passage.

20. The component of claim 19 wherein said spacer defines two fluid displacement passages that share a common centerline.

* * * * *